US006598948B1

(12) United States Patent
Harmon

(10) Patent No.: US 6,598,948 B1
(45) Date of Patent: Jul. 29, 2003

(54) SHOE STORAGE DEVICE

(76) Inventor: Jonathan L Harmon, 116-51 157th St., Apt. 8-J, Jamiaca, NY (US) 11434

( * ) Notice: Subject to any disclaimer, the term of this patent is extended or adjusted under 35 U.S.C. 154(b) by 0 days.

(21) Appl. No.: 10/094,891

(22) Filed: Mar. 11, 2002

(51) Int. Cl.[7] ..... A24F 25/00
(52) U.S. Cl. ..... 312/31.01; 211/34
(58) Field of Search ..... 312/31.01, 31, 312/266, 267, 268; 211/121, 35, 34, 1.57

(56) References Cited

U.S. PATENT DOCUMENTS 5,369,892 A * 12/1994 Dhaemers ..... 34/275
5,984,113 A * 11/1999 Roberson ..... 211/34
6,086,171 A * 7/2000 Ashley et al. ..... 312/97.1

FOREIGN PATENT DOCUMENTS

JP 02156904 A * 6/1990 ..... A47B/61/04

* cited by examiner

*Primary Examiner*—Leslie A. Braun
*Assistant Examiner*—A. Joseph Wujciak

(57) ABSTRACT

A shoe storage device is provided having two rotation members that are rotated by a motor. The rotation members have swinging shoe platforms that are rotated such that each, in turn, is proximate a transparent access hatch such that the displayed shoes can be removed. The housing interior is illuminated by a light assembly and the interior air is humidified by a humidifier.

28 Claims, 10 Drawing Sheets

SHOE STORAGE DEVICE

BACKGROUND OF THE INVENTION

1. Field of the Invention

The present invention relates generally to protective shoe containers and more specifically to a shoe storage device that encloses and preserves the shoes, from dirt dust and humidity.

2. Description of the Prior Art

There are other shoe containers designed for protecting shoes but none combine the use of a rotational mechanism with humidifying and dehumidifying capabilities and neither is combined in the use of preserving shoes.

Typical of these and other humidifying or storage devices, generally, is U.S. Pat. No. 3,042,472 issued to Charles J. Ibel on Jul. 3, 1962. Another patent was issued to Geraldine McGeer Appleby on Jun. 29, 1971 as U.S. Pat. No. 3,589,785. Yet another U.S. Pat. No. 4,312,550 was issued to Kenneth E. Jackson on Jan. 26, 1982 and still yet another was issued on May 6, 1986 to Masao Morishita et al. as U.S. Pat. No. 4,586,342.

Another patent was issued to Byung-Do Im et al., on May 26, 1987 as U.S. Pat. No. 4,667,817. Yet another U.S. Pat. No. 4,711,294 was issued to Allophones F. Jacobs et al. on Dec. 8, 1987. Another was issued to Lisbet Thoresen et al. on Jun. 7, 1988 as U.S. Pat. No. 4,749,241 and still yet another was issued on Jun. 13, 1989 to William M. Robertson, et al. as U.S. Pat. No. 4,838,911.

Another patent was issued to Shelley R Paine et al. on Jul. 7, 1992 as U.S. Pat. No. 5,127,718. Yet another U.S. Pat. No. 5,191,736 was issued to Katsuyoshi Iino, et al. on Mar. 9, 1993. Another was issued to Cosmas Malin Mauren, et al. on Apr. 7, 1998 as U.S. Pat. No. 5,735,587, and still yet another was issued on Nov. 25, 1988 to Somajini Georges as French Patent No. FR2615380.

U.S. Pat. No. 3,042,472

Inventor: Charles J. Ibel

Issued: Jul. 3, 1962

In a filing cabinet or the like having a pair of spaced vertical supports a pair of sprockets mounted at the top and bottom of each support a vertical link chain passing over each of said pair of sprockets means for actuating said sprockets and chains a plurality of spaced horizontal shelves between said chains the ends of the said shelves being pivotally held on corresponding links of the respective chains the improvement which comprises a plurality of pairs of spaced brackets mounted on a pair of adjacent links of said chains and extending outwardly therefrom, a pivot on the upper of each pair of brackets, a shelf on which said pivot is fixed, a pin in the lower of said pair of brackets and extending towards said shelf, an additional bracket between said adjacent links, a pin on said additional bracket and in alignment with said first pin and pivot when said pair of brackets and additional bracket are in horizontal position, a pendant on said pivot and depending toward said lower bracket the lower end of said pendant having an inverted V-shaped notch, the distance between the pivot of said pendant and apex of said notch being equal to the distance between the pins of adjacent brackets. of adjacent brackets.

U.S. Pat. No. 3,589,785

Inventor: Geraldine McGeer Appleby

Issued: Jun. 29, 1971

A shelf conveyor apparatus for use with a kitchen cabinet formed with an access opening in its front wall and adapted for storage of a plurality of various height articles. The apparatus includes a vertically disposed endless conveyor means for disposition in said cabinet and including a series of connectors spaced therealong. A plurality of shelves are provided with hangers for interchangeable connection with the respective connectors whereby the hangers of certain shelves may be connected with connectors spaced at predetermined distances to space such certain shelves apart for convenient receipt therebetween of articles of one height and the hangers of other shelves may be connected with connectors spaced apart at different distances to space such other hangers apart for convenient receipt therebetween of articles of another height. Thus the conveyor means may be operated to selectively advance selected ones of the shelves into registration with the access opening for convenient viewing of the articles stored thereon and for ready access to such articles. The shelves may substantially narrower than conventional kitchen cabinet shelves while still utilizing the entire depth of a conventional cabinet thereby eliminating the inconvenience of having certain of the articles stored at the back of a relatively deep shelf and making it difficult to view such articles from the front of the shelf and necessitating reaching and groping over and between articles disposed at the front of the shelf to acquire such articles located at the rear of the shelf.

U.S. Pat. No. 4,312,550

Inventor: Kenneth E. Jackson

Issued: Jan. 26, 1982

A display case for use in exhibiting jewelry and incorporating a pair of sidewalls in its structure, spaced apart a fixed distance, grooves being routed into each sidewall wherein drive linkage or chain are located, and driven by a drive shaft turned by an electric or other motor. Each of the drive chains revolve simultaneously, so that display trays or shelves held at each end by each of the sidewall disposed linkages are revolved about the display case for exhibiting merchandise.

U.S. Pat. No. 4,586,342

Inventor: Masao Morishita, Ibaraki et al.

Issued: May 6, 1986

A dehumidifying and cooling apparatus for keeping the inside of a box containing an electric apparatus at a predetermined temperature and low humidity is provided. The apparatus comprises an electronic cooling element fixed to a heated end of a heat pipe extending through the box, the electronic cooling element and a cooling portion being respectively located inside the box, and a radiating portion being located outside the box, the cooling portion being located inside a vertical vent guide provided within the box, so that the dehumidifying and cooling apparatus can be compact and capable of dehumidifying and cooling the inside of the box efficiently.

U.S. Pat. No. 4,667,817

Inventor: Byung-Do Im, et al.

Issued: May 26, 1987

A shoe case for storing a pair of shoes is provided and includes a built-in unit for dehumidifying the pair of shoes. The unit can also deodorize the pair of shoes.

U.S. Pat. No. Des. 4,711,294

Inventor: Alphonse F. Jacobs, et al.

Issued: Dec. 8, 1987

A system for controlling the temperature and humidity of an enclosure such as a museum display case continuously extracts air from the enclosure, increases its humidity cools it to a controlled temperature at which point its humidity is 100%. The air is then heated and returned to the enclosure. By selection of the controlled temperature the relative humidity of the returned air may be determined.

U.S. Pat. No. 4,749,241

Inventor: Lisbet N. Thoresen, et al.

Issued: Jun. 7, 1988

A display case for supporting and viewing of a museum piece, the case including a base providing a lower chamber for a humidity buffer and a transparent cover providing an upper chamber for the piece on display. The case is substantially airtight, with sealed access ports in the base for inserting and removing humidity buffer containers, and with a clamped soft seal between the cover and base for removal of the cover to provide access to the display space. In the preferred embodiment, the humidity buffer is contained in cylindrical containers which rest on a sloping shelf in the base for ease of handling, and the lower and upper chambers are separated by a platform which provides a restricted airflow path between the chambers so that opening an access port does not result in substantial airflow into or out of the upper chamber.

U.S. Pat. No. 4,838,911

Inventor: William M. Robertson, et al.

Issued: Jun. 13, 1989

A videotape storage cabinet is disclosed which includes a housing having a base portion supporting a videotape cooling compartment, a heat sink compartment, and a top, the top for supporting the videotape user equipment. A temperature controlled thermoelectric heat pump is mounted between the compartments with a cold sink and a heat sink extending into the cooling and heating compartments, respectively. The cold sink provides videotape bins designed to. support videotapes individually for cooling by the cold sink. A drawer is provided in the cooling compartment for a drying agent. The drying agent may be in either packaged form or bulk form for placement in the drawer. The drying agent is to control the moisture content of the cold air in the cooling compartment. The controlled temperature thermoelectric heat pump is set to maintain the cooling compartment to 65–70 degrees Fahrenheit, and the drying agent sufficient to maintain the relative humidity between 35–45 percent for preservation of the videotapes during storage. The drying agent can be replaced by a small dehumidifying thermoelectric heat pump mounted in the cooling compartment, and a drain provided to remove the moisture.

U.S. Pat. No. 5,127,718

Inventor: Shelley R. Paine, et al.

Issued: Jul. 7, 1992

A sealed display and storage case is disclosed for viewing and storing a museum piece or the like in a protected and controlled environment. The display case includes a base having apertures therethrough, a top cover and a bottom cover. A first seal mechanism attaches the top cover to the base providing an upper microclimate chamber, and a second seal mechanism attaches the bottom cover to the base, providing a lower microclimate chamber. The apertures within the base limit air flow exchange between the upper and lower microclimate chambers. A rotatable disc mechanism is used to close the apertures when either cover is removed for servicing, thereby eliminating outside air flow into the unopened microclimate chamber. The humidity buffer is contained within an open vessel having an externally adjustable lid, thereby providing a way to adjust the microclimates without any outside air flow into the chambers.

U.S. Pat. No. 5,191,736

Inventor: Katsuyoshi Iino, et al.

Issued: Mar. 9, 1993

A structure for locking a display case door including a door handle, a pair of support members supporting the end portions of the handle, a lower support member of which has a through hole, and a locking piece extendably and retractably below the lower support member and having a through hole capable of facing the through hole of the lower support member so that an arm of a lock can be inserted through the both through holes. Since the locking piece can be positioned below and within the lower support member it does not become any obstruction to the customers. A structure for treating dew drops dropped from a door of a display case including a tray for catching the dropped dew drops, a dew drops scattering inhibitor plate on the front portion of the tray, and a guide path on the rear portion of the tray and sloped down toward a machine room. The dropped dew drops are prevented from being scattered by the inhibitor plate and the collected water quickly and efficiently guided into the machine room by the sloped guide path. A structure for easily attaching without screws a packing support plate to a display case frame has grooves at least on its both inner side surfaces and the packing support plate has flange portions to be inserted into the grooves.

U.S. Pat. No. 5,735,587

Inventor: Cosmas Malin, Mauren

Issued: Apr. 7, 1998

A climate cabinet, turntable and use of the turntable. The climatic cabinet can be loaded automatically and manually and has a conventional door and a controllable door as well as a turntable which is connected via a releasable coupling disposed in the interior of the climatic cabinet with a positioning drive and is seated on the floor of the climatic cabinet. The controllable door is movably seated on two guide systems perpendicularly and parallel with the loading side. The positioning drive is controllable by a higher system or by a user. The turntable has a support shaft tray disks and spacer sleeves as well as spacer tubelets for spacing the tray disks apart, also positioning elements for receiving storage pieces. The turntable is suitable for use in a device for example a climatic cabinet, or outside of this device.

French Patent Number FR2615380

Inventor: Georges, Somajini

Published: Nov. 25, 1998

The subject of the invention is a display case. The display case can be seen with a horizontal rolling rack on which housings are fixed; the display case has a parallelepipedal shape and a front window; the front window reveals several housing; the rolling track comprises teeth which mesh with vertical spindles on which there are mounted toothed cylinders or wheels, at least one of which is connected, for example by a transmission belt, to the shaft of an electric motor. The invention applies to the storage and/or display of cassettes, books or the like.

While these devices may be suitable for the purposes for which they were designed, they would not be as suitable for the purposes of the present invention as hereinafter described. For example, no of these devices provide a special housing, with a humidified interior, that stores and protects shoes on specially designed display platforms that are automatically movable in position to be illuminated for viewing through a transparent hatch, through which the shoes may be removed or inserted.

SUMMARY OF THE PRESENT INVENTION

A primary object of the present invention is to provide a suitable enclosed unit in which shoes can be stored and preserved.

Another object of the present invention is to provide a climate controlled enclosure for the storage of shoes.

Yet another object of the present invention is to provide easy accessibility to stored item.

Still yet another object of the present invention is to provide the use of rotational shoe display platforms, which allow easy retrievability.

Another object of the present invention is to provide interior lighting as a visual aid in selecting shoes for removal.

Still yet another object of the present invention is to provide a low cost and self-sufficient unit.

Additional objects of the present invention will appear as the description proceeds.

The present invention overcomes the shortcomings of the prior art by providing a space saving, compact means of storing shoes in a climatically controlled environment thereby giving shoes a longer life span.

The device is an enclosed mechanism where shoes are stored on a plurality of display platforms suspended for continuous motor-driven rotation.

In one embodiment, there is provided a shoe storage device, comprising: a housing having an interior and a closable access portion; a humidifier positioned on the housing for humidifying the air in the housing interior, the humidifier having controls for regulating the degree of humidification; a first and second pulley, each positioned within the housing for rotation; a rotation member positioned on the housing for rotation, the rotation member having a shaft and a first and second pulley attached to the shaft; a first belt for connecting the first pulleys, and a second belt for connecting the second pulleys; a motor having controls, the motor being in rotative communication with the rotation member; and at least two shoe display assemblies, each display assembly having an elongated member, the elongated member having first and second ends attached to the first and second belts, each display assembly also having a platform and suspension members for suspending the platform from the elongated member, the suspension members being rotatable about the elongated member and the platform being rotatable on the suspension members, the platform being sized to support at least two shoes, the operation of the motor rotating the rotation member, the rotation member's first and second pulleys causing the first and second belts to rotate, the rotation of the belts carrying the at least two display assemblies along the first and second belt rotation path, each of the at least two platforms being proximate the closable access portion at some point in the first and second belt rotation path, such that the opened access portion provides access to the shoes for removal from the housing.

In another embodiment, the shoe has a heel having forward edge and the display assembly platform has an elevated portion, the elevated portion being adapted to be adjacent the heel forward edge, such that, when the platform tips forward from the horizontal, the elevation prevents the shoe from sliding off the platform.

In another embodiment, the closable access portion is at least partially transparent such that the platform supported shoes are at least partially visible when proximate the closable access portion.

In another embodiment, the device further comprises a gear assembly, the gear assembly providing the rotative communication between the motor and the rotation member.

In another embodiment, the gear assembly comprises a sprocket gear attached to the rotation member and a worm gear attached to the motor such that the motor rotates the worm gear and the worm gear rotates the sprocket gear.

In another embodiment, the device further comprises a damper for damping the motor's operational vibrations.

In another embodiment, the motor controls include an on-off function.

In another embodiment, the motor controls include a speed variation function.

In another embodiment, the motor controls include a forward-reverse function.

In another embodiment, the motor controls include an automatic stop function such that each of the display assemblies is automatically stopped proximate the closable access portion.

In another embodiment, the motor controls include an on-off function, a speed variation function, a forward-reverse function, and an automatic stop function such that each of the display assemblies is automatically stopped proximate the closable access portion.

In another embodiment, the device further comprises a light assembly having a light member and controls, the light assembly being positioned on the housing such that the shoes are at least partially illuminated by the light member when the shoes are proximate the closable access portion.

In another embodiment, the at least two display platforms are attached to the suspension members such that the platform is substantially horizontal when the platform is unloaded.

In another embodiment, the at least two display platforms are attached to the suspension members such that the platform tips forward when the platform is unloaded.

In another embodiment, each of the at least two display assembly platforms further comprise at least one fastener for securing at least one of the shoes to the platform.

In one embodiment, a shoe storage device is provided, comprising: a housing having an interior and a closable access portion; means for humidifying the housing interior; at least two shoe display assemblies each sized for supporting at least one pair of shoes; support means for supporting the display assemblies; and means for rotating the support means such that each display assembly is successively positioned proximate the closable access portion such that the opened access portion provides access to the shoes for removal from the housing.

In another embodiment, each shoe has a heel, the heel having a forward edge, and each shoe display assembly further comprises means for obstructing the heel during relative movement between the shoe and the display assembly.

In another embodiment, each shoe display assembly further comprises means for securing the shoes on the display assembly.

In another embodiment, the device further comprises means for damping the motor's operational vibrations.

In another embodiment, the means for rotating the support means includes an on-off function.

In another embodiment, the means for rotating the support means includes a rotation speed variation function.

In another embodiment, the means for rotating the support means includes a forward-reverse function.

In another embodiment, the means for rotating the support means includes an automatic stop function such that each of the display assemblies is automatically stopped proximate the closable access portion.

In another embodiment, the means for rotating the support means includes an on-off function, a speed variation function, a forward-reverse function, and an automatic stop function such that each of the display assemblies is automatically stopped proximate the closable access portion.

In another embodiment, the device further comprises means for at least partially illuminating the shoes when the shoes are proximate the closable access portion.

In another embodiment, each of the at least two display assembly platforms further comprise means for securing at least one of the shoes to the platform.

In one embodiment, there is provided a shoe storage device, comprising: a housing having an interior and a closable access portion; a humidifier positioned on the housing for humidifying the air in the housing interior, the humidifier having controls for regulating the degree of humidification; a first and second pulley, each positioned within the housing for rotation; a rotation member positioned on the housing for rotation, the rotation member having a shaft and a first and second pulley attached to the shaft; a first belt for connecting the first pulleys, and a second belt for connecting the second pulleys; a motor having controls, the motor being in rotative communication with the rotation member; and at least two shoe display assemblies, each display assembly having an elongated member, the elongated member having first and second ends attached to the first and second belts, the attachment allowing rotation of the elongated member ends with respect to the belts, each display assembly also having a platform and suspension members for suspending the platform from the elongated member, the platform being rotatable on the suspension members, the platform being sized to support at least two shoes, the operation of the motor rotating the rotation member, the rotation member's first and second pulleys causing the first and second belts to rotate, the rotation of the belts carrying the at least two display assemblies along the first and second belt rotation path, each of the at least two platforms being proximate the closable access portion at some point in the first and second belt rotation path, such that the opened access portion provides access to the shoes for removal from the housing.

There is provided a shoe storage device, comprising: a housing having an interior and a closable access portion, the closable access portion being at least partially transparent; a humidifier positioned on the housing for humidifying the air in the housing interior, the humidifier having controls for regulating the degree of humidification; a first and second pulley, each positioned within the housing for rotation; a rotation member positioned on the housing for rotation, the rotation member having a shaft and a first and second pulley attached to the shaft; a first belt for connecting the first pulleys, and a second belt for connecting the second pulleys; a motor having controls; and a gear assembly having a sprocket gear attached to the rotation member and a worm gear attached to the motor such that the motor rotates the worm gear and the worm gear rotates the sprocket gear; a damper for damping motor vibrations; at least two shoe display assemblies, each display assembly having an elongated member, the elongated member having first and second ends attached to the first and second belts, each display assembly also having a platform, the platform having an elevated portion, and suspension members for suspending the platform from the elongated member, the suspension members being rotatable about the elongated member and the platform being rotatable on the suspension members, the platform being sized to support at least two shoes: such that the rotation member is rotated by the sprocket gear, the rotation member's first and second pulleys causing the first and second belts to rotate, the rotation of the belts carrying the at least two display assemblies along the first and second belt rotation path, each of the at least two display assemblies being proximate the closable access portion at some point in the first and second belt rotation path, such that the opened access portion provides access to the shoes for removal from the housing; and further such that, when the platform tips forward from the horizontal, the elevation prevents the shoe from sliding off the platform; and further wherein the motor controls include an on-off function, a speed variation function, a forward-reverse function, and an automatic stop function such that each of the display assemblies is automatically stopped proximate the closable access portion; and a light assembly having a light member and controls, the light assembly being positioned on the housing such that the shoes are at least partially illuminated by the light member when the shoes are proximate the closable access portion.

The foregoing and other objects and advantages will appear from the description to follow. In the description reference is made to the accompanying drawings which form a part hereof and in which is shown by way of illustration specific embodiments in which the invention may be practiced. These embodiments will be described in sufficient detail to enable those skilled in the art to practice the invention and it is to be understood that other embodiments may be utilized and that structural changes may be made without departing from the scope of the invention. In the accompanying drawing like reference characters designate the same or similar parts throughout the several views.

The following detailed description is therefore not to be taken in a limiting sense and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a perspective view of the present invention. Shown is an exterior view having a humidity-controlled enclosure used to preserve shoes.

FIG. 2 is a front view of the present invention. The shoe preserver has a housing with a transparent hinged access panel for inserting and removing shoes therefrom. An exterior control panel provides for controlling the rotating shelves and the humidifier.

FIG. 3 is a top view of the present invention. This drawing depicts the location of the lighting unit shown in outline. When the access door is opened the light will illuminate.

Figure 6:
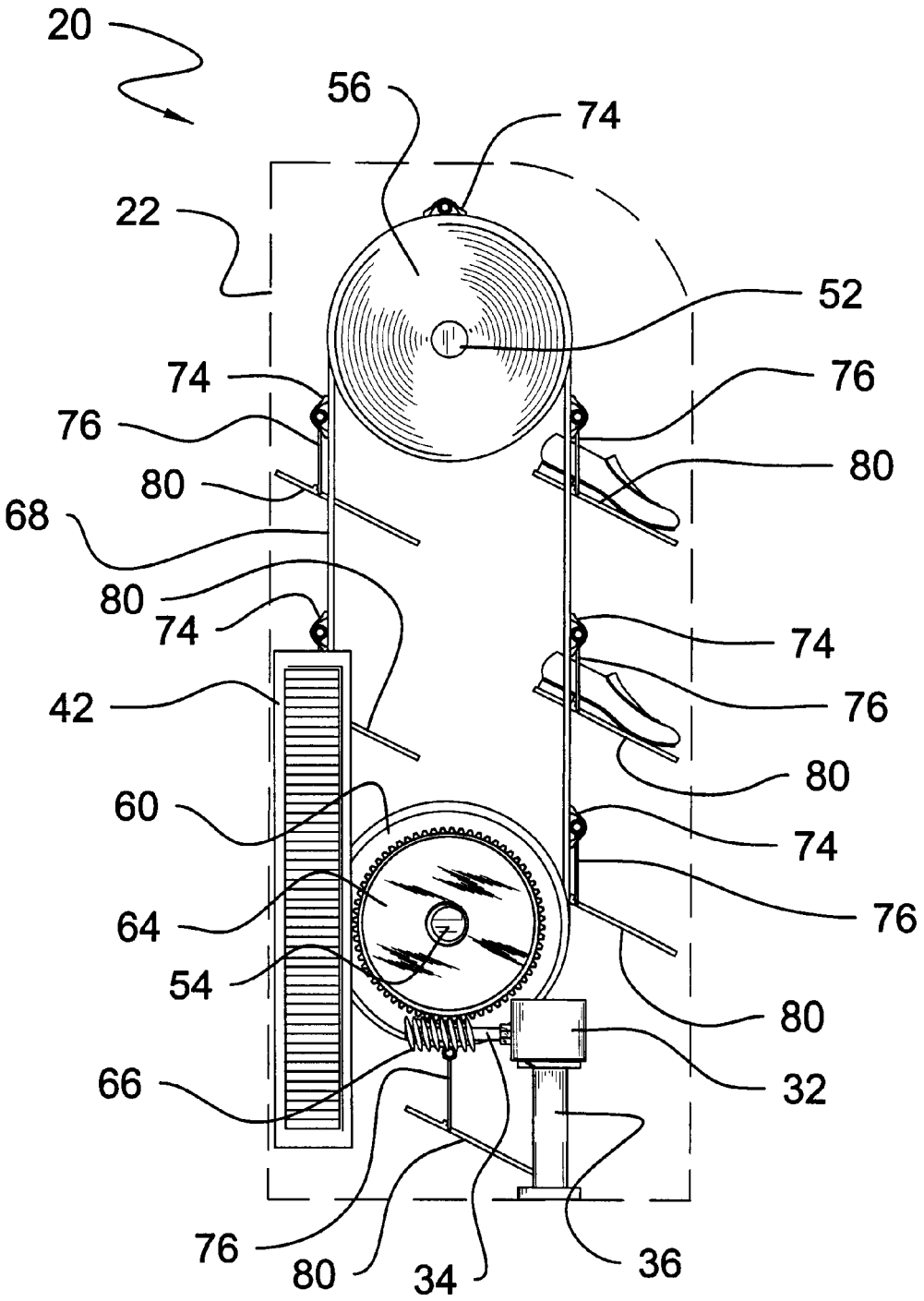

FIG. 6 is a side view of the present invention. Shown is a motor having a worm gear engaging a sprocket gear that turns a first shaft, which then turns a pair of pulleys with transmission belts extending to another pair of pulleys. The belts have a plurality of shelves attached thereto whereby one or more pairs of shoes can be selectively positioned thereon. Also shown is the humidifier used to control humidity within the apparatus.

Figure 7:
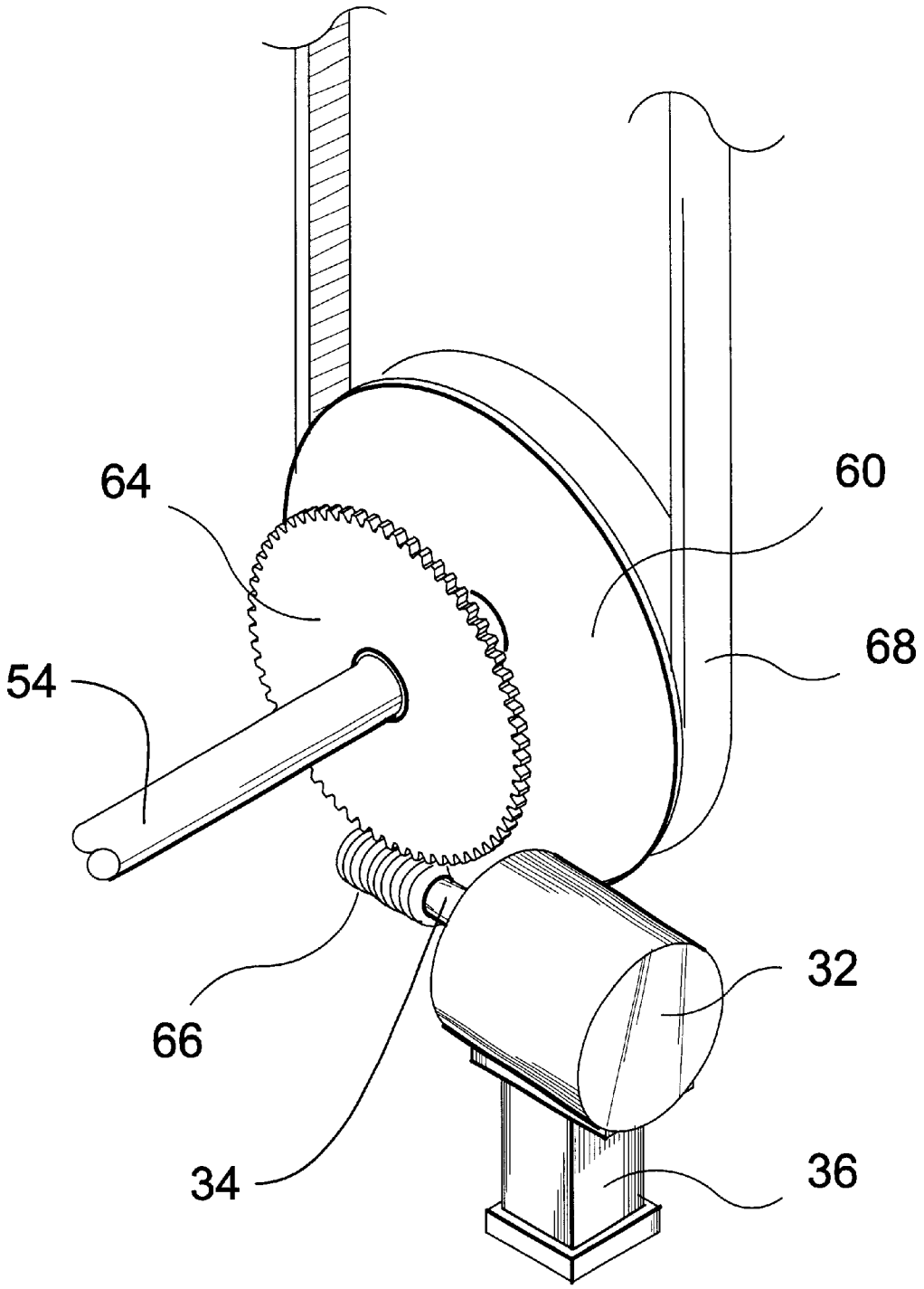

FIG. 7 is an enlarged view of the gear assembly of the present invention.

Figure 8:
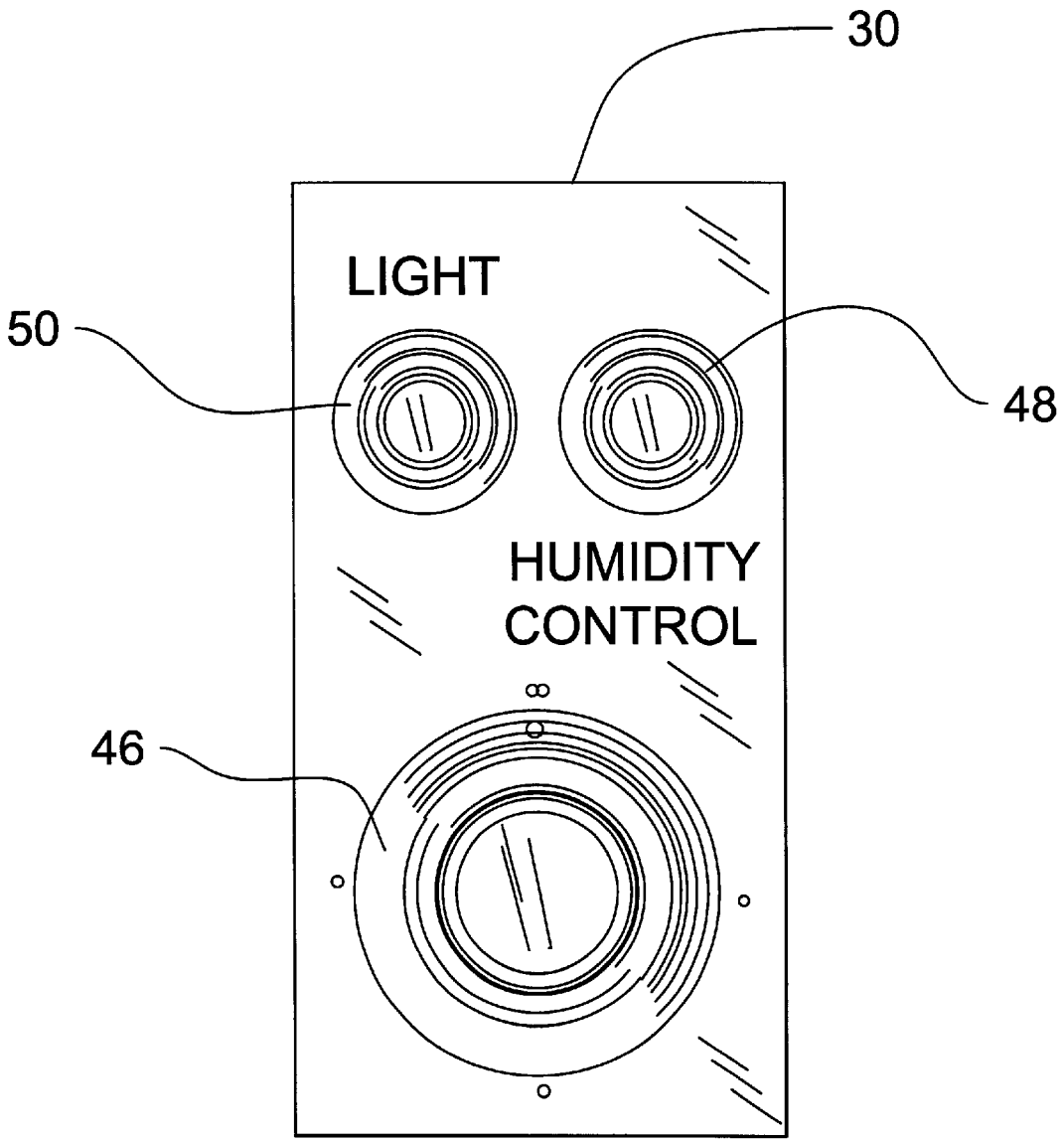

FIG. 8 is an enlarged view of the control panel having controls for the motor, light assembly, and humidifier.

Figure 9:
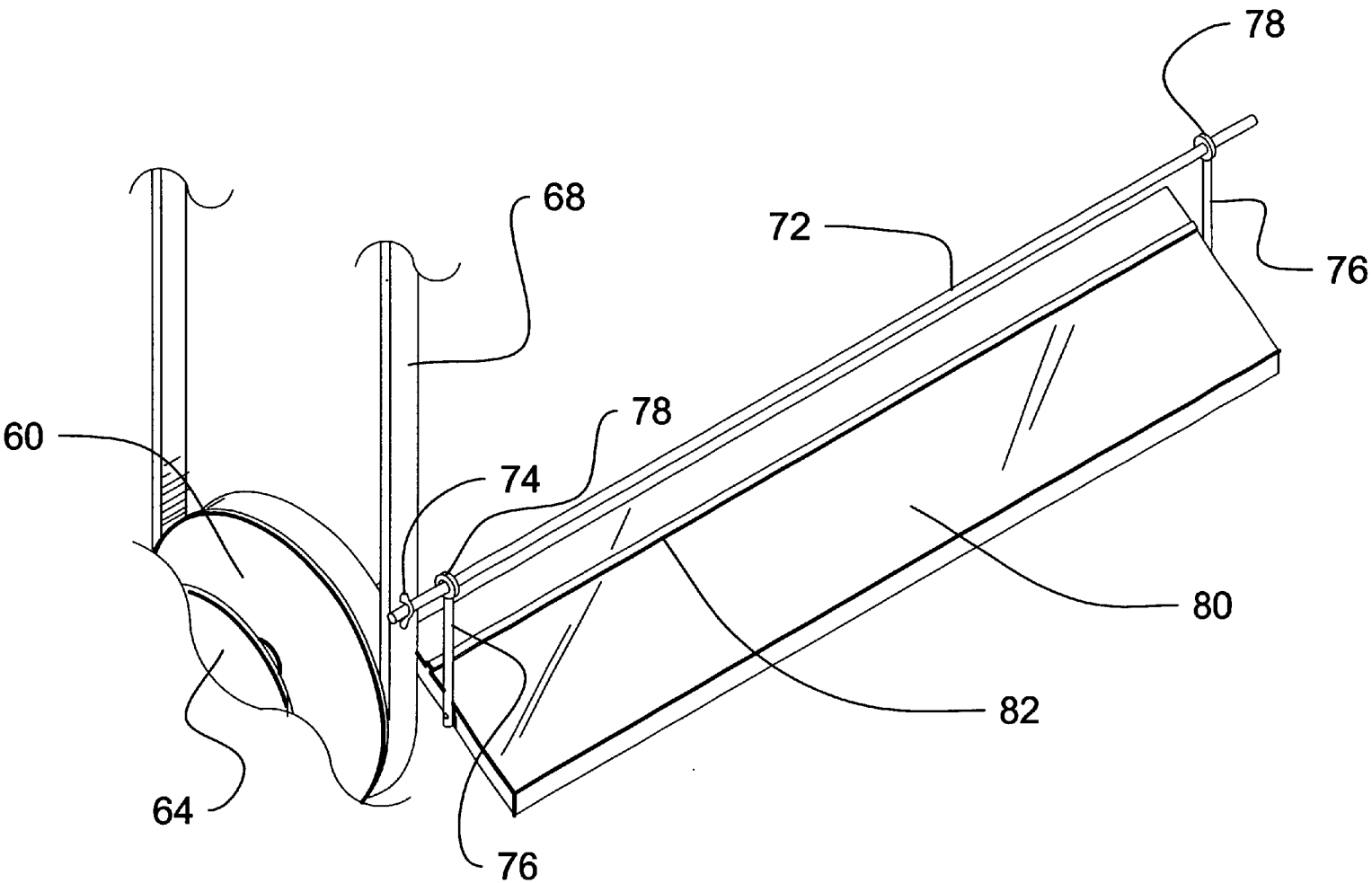

FIG. 9 is an enlarged drawing of a shoe display platform of the present invention. The elevated heel stop and the suspension members are permanently affixed to the platform and are supported by a rod that is freely rotatable by use of bearings.

Figure 10:
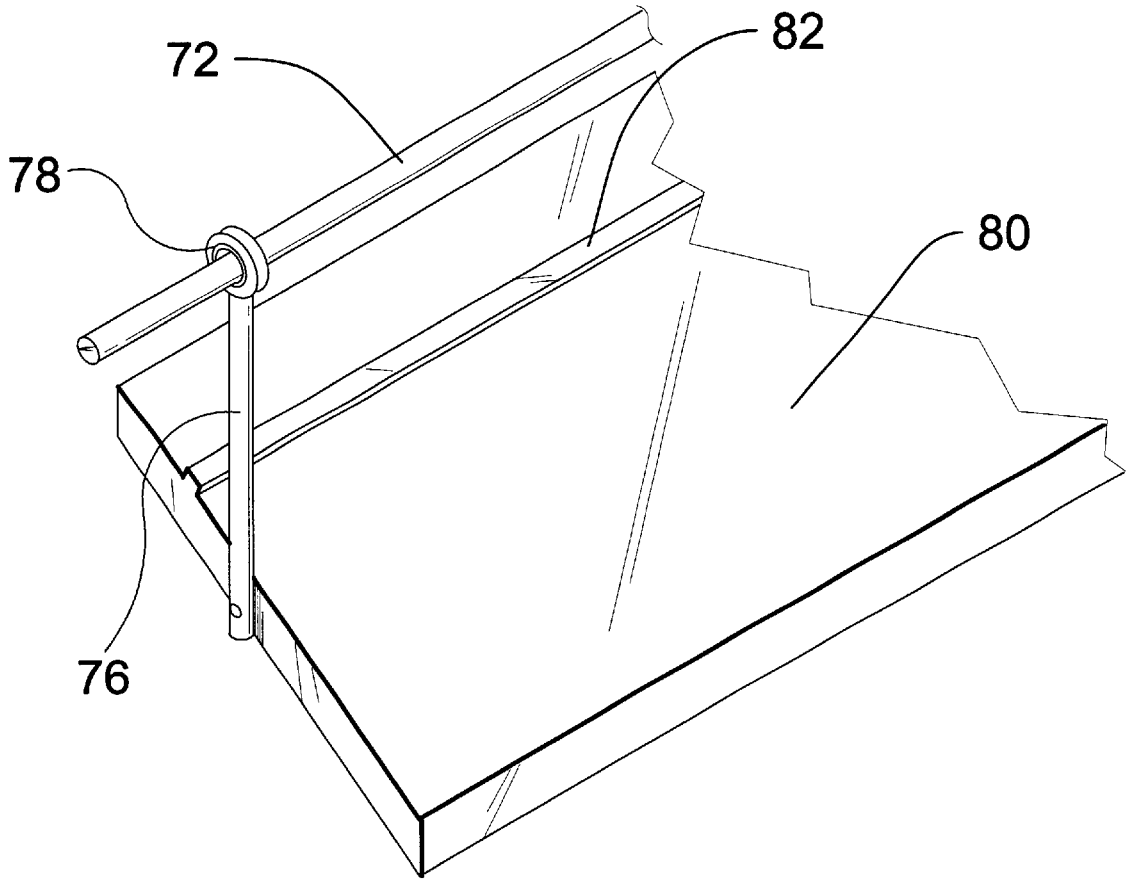

FIG. 10 is a partial view of the shoe display platform with an enlarged view of the suspension member bearings. The bearings allow free rotation of the suspension members and allows the shelf to keep an approximately forty-five degree angle while rotating.

DESCRIPTION OF THE REFERENCED NUMERALS

Turning now descriptively to the drawings, in which similar reference characters denote similar elements throughout the several views, the figures illustrate the Shoe Storage Device of the present invention. With regard to the reference numerals used, the following numbering is used throughout the various drawing figures.

20 Shoe Storage Device of the present invention
22 housing
24 transparent housing door
26 housing door hinge
28 housing interior
30 control panel
32 motor
34 motor shaft
36 motor vibration damper
38 power cord
40 humidifier
42 humidifier ventilation grill
44 light assembly
46 motor control knob
48 humidifier control knob
50 light assembly control knob
52 first shaft
54 second shaft
56 first shaft first pulley
58 first shaft second pulley
60 second shaft first pulley
62 second shaft second pulley
64 sprocket gear
66 worm gear
68 first belt
70 second belt
72 display assembly rod
74 rod connectors
76 rod suspension member
78 suspension member bearing
80 display assembly platform
82 platform elevation
100 shoes

DETAILED DESCRIPTION OF THE INVENTION

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
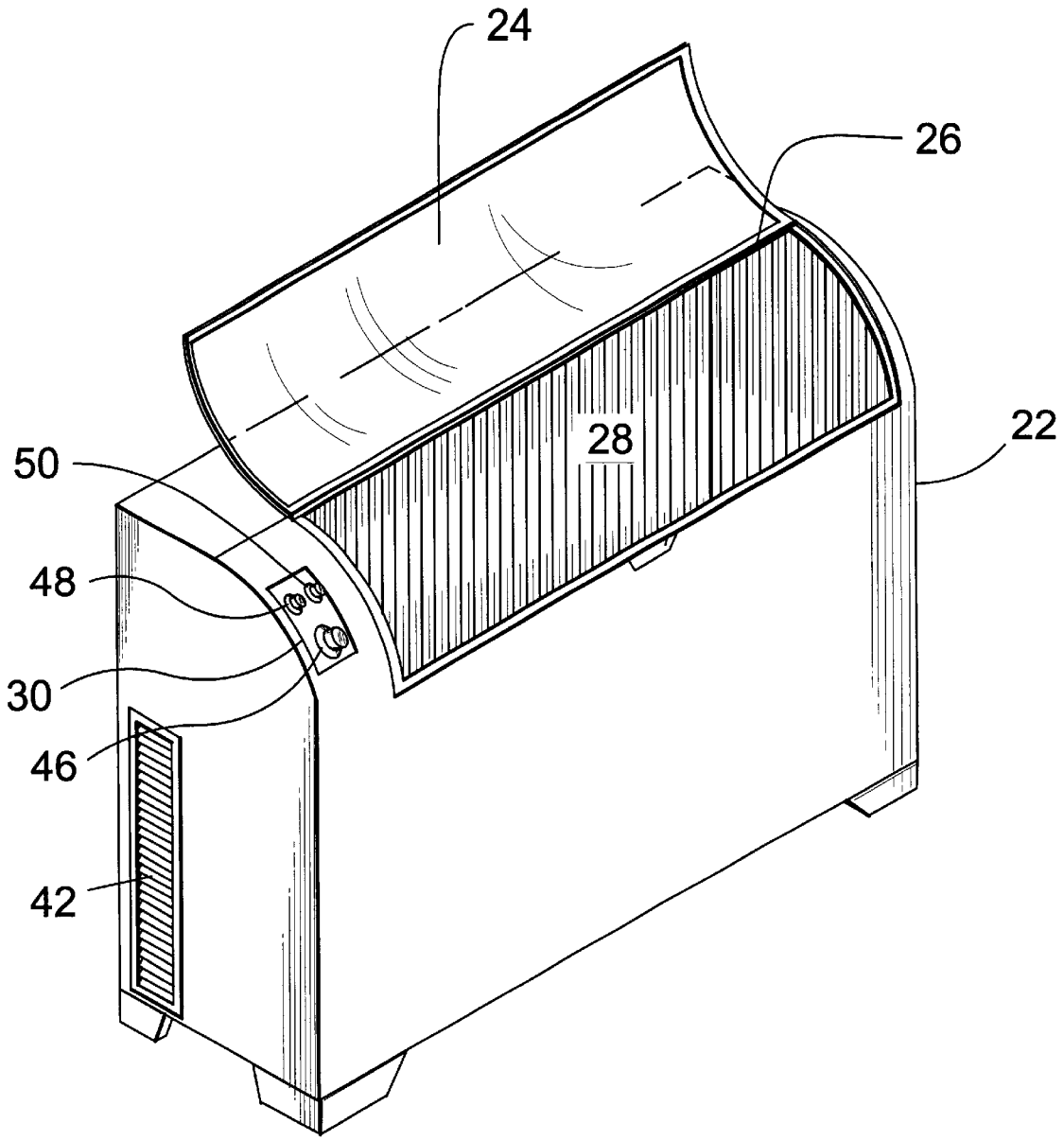
Figure 2:
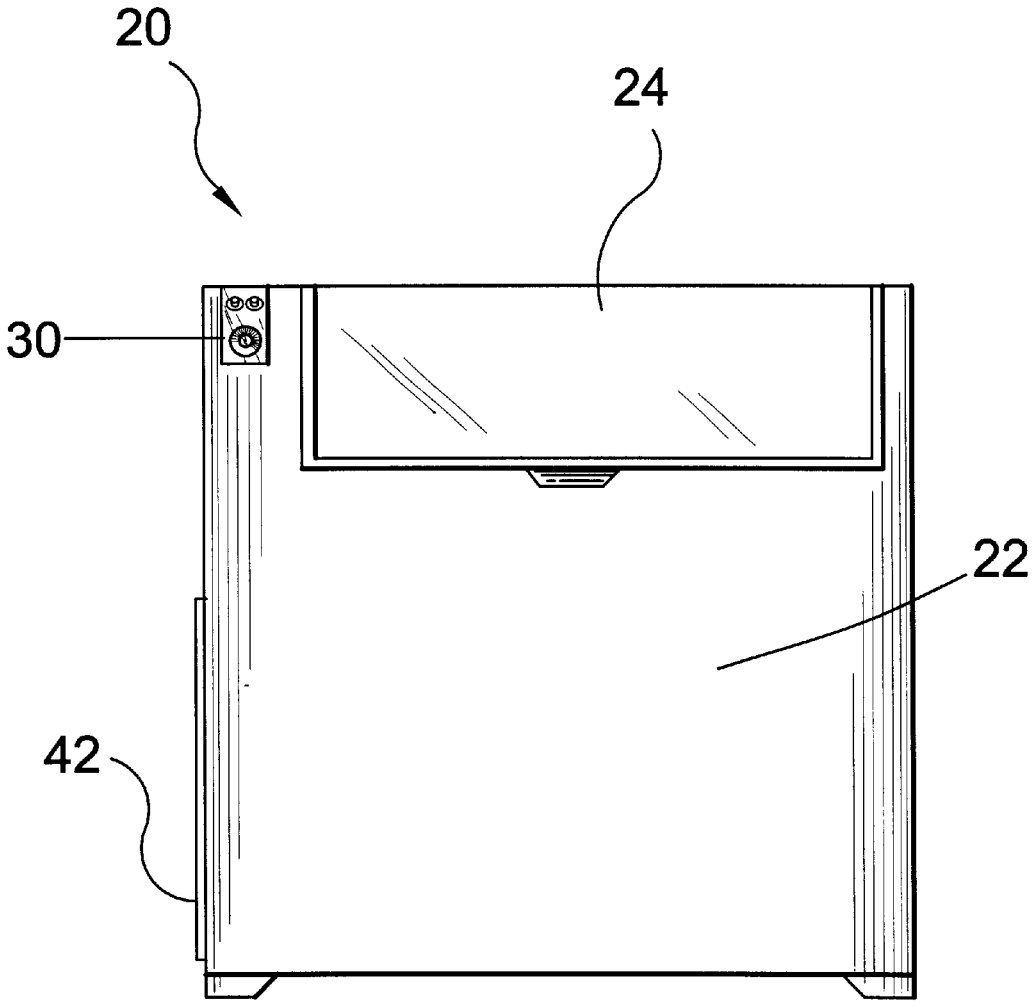
Figure 3:
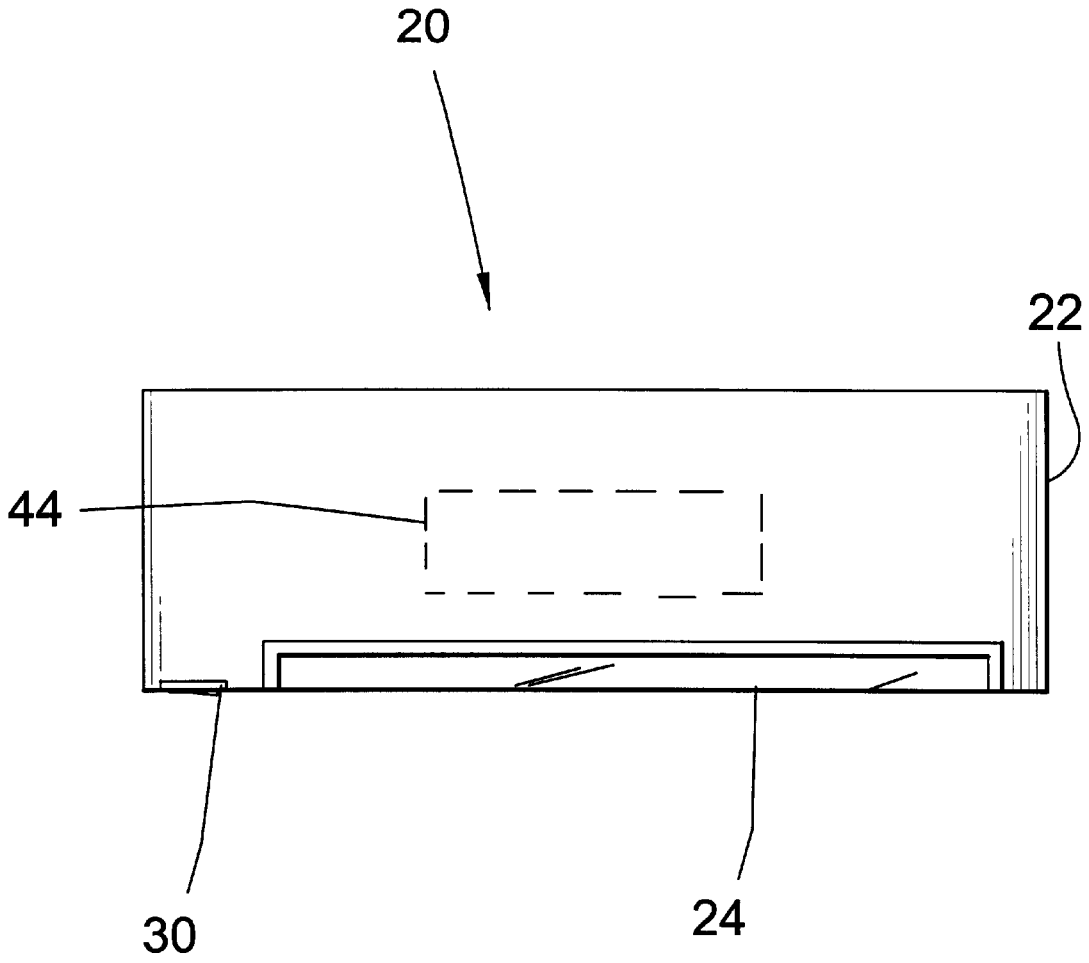
Figure 4:
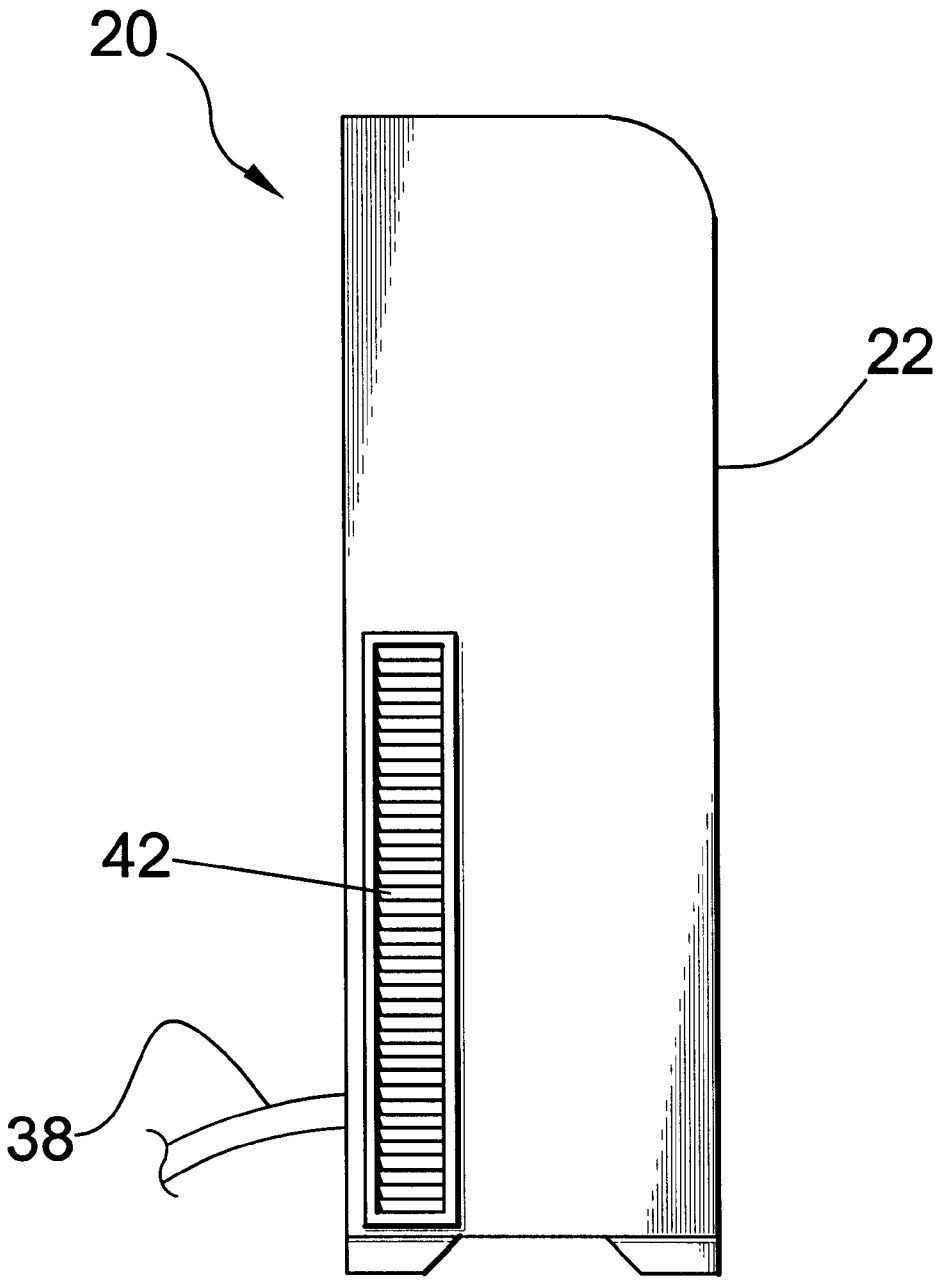
FIG. 4 is a left exterior view of the present invention. This view shows the location of the louvered vents for the humidifier and an electrical connection for power.

As shown in FIGS. 1–3, the shoe storage device 20 of the present invention has a housing 22 with a transparent access hatch 24 that swings on hinges 26. The hatch 24 provides access to the housing interior 28. A control panel 30 is positioned near the front top of the housing 22.

A conventional electric motor 32 with a shaft 34 is mounted on a damper 36 within the housing 22, the motor 32 having a power cord 38, as shown in FIGS. 4–7.

The power cord 38 also powers a conventional humidifier 40 positioned on the housing 22 within the interior 28, the humidifier 40 having vents 42 exiting the housing 22. A humidifier similar to that disclosed by Jacobs, et al. In U.S. Pat. No. 4,711,294 (incorporated herein by reference) can be modified for the purposes of the present invention.

A conventional light assembly 44 is also powered by the power cord 38 and is positioned on the top of the housing 22 to illuminate the housing interior 28.

As shown in FIG. 8, the control panel 30 includes motor controls 46 that include on-off, variable speed, and reverse direction functions. In other embodiments, the motor controls include automatic stop functions. The control panel 30 also includes humidifier controls 48 for regulating the degree of humidification in the housing interior 28, and light assembly controls 50 including on-off and variable light intensity functions. The light assembly 44 is turned on and off by the opening and shutting of the hatch 24 in another embodiment.

Figure 5:
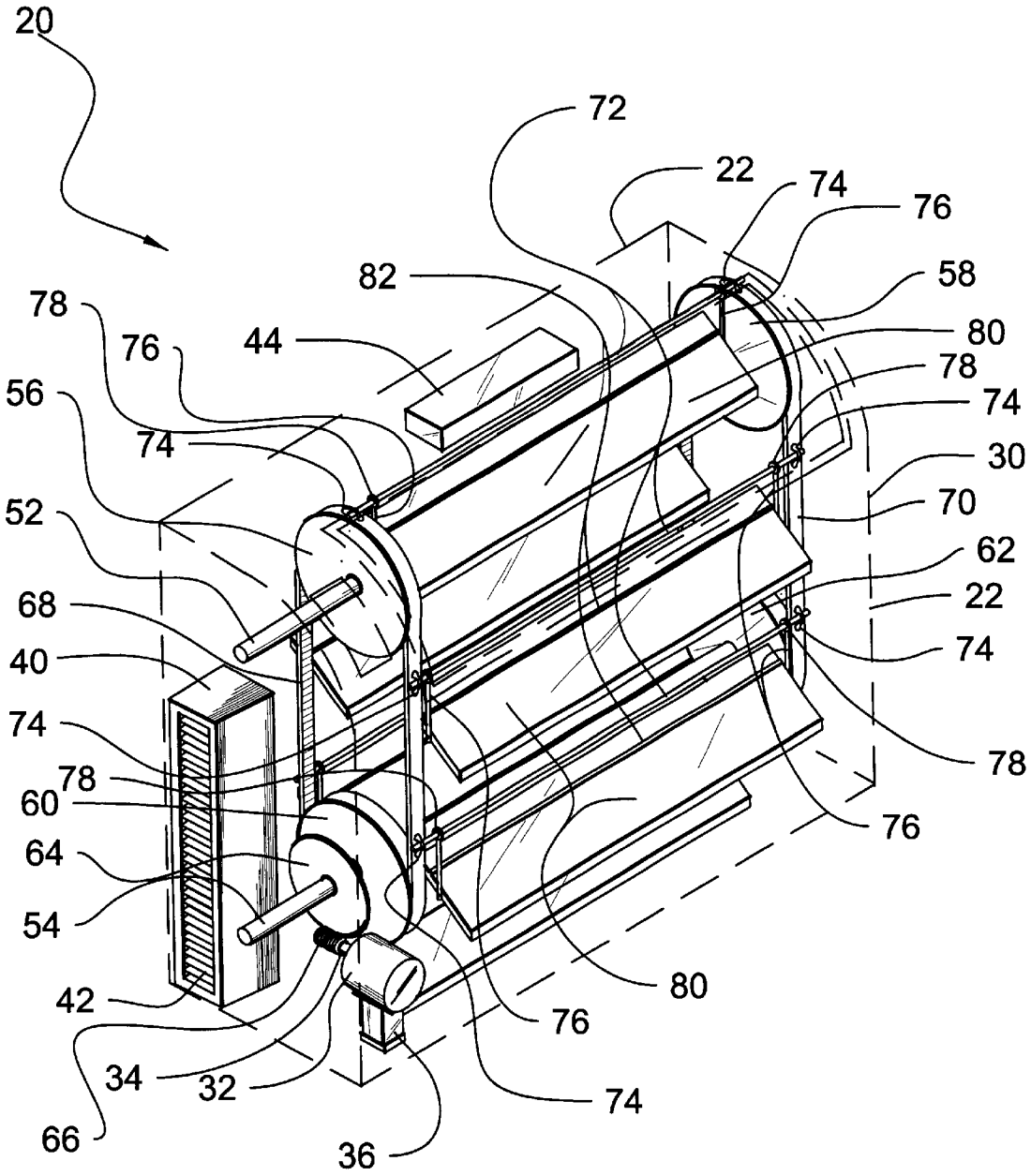
FIG. 5 is a perspective view of the interior mechanism of the present invention. Shown is a plurality of display platforms connected to spaced away belts having rotative elements connected by gears to a motor whereby the display platforms can be selectively positioned adjacent a hingedly connected transparent access hatch.

As shown in FIG. 5, a first shaft 52 and a second shaft 54 are mounted within the housing 22 and are free to rotate. The first shaft 52 has a first pulley 56 and a second pulley 58. The second shaft 54 has a first pulley 60, vertically aligned with the first shaft first pulley 56, and a second pulley 62, vertically aligned with the first shaft second pulley 58. In another embodiment, the first shaft first and second pulleys 56,58 are positioned independently within the housing, without the first shaft 52.

Attached to the second shaft 54 is a sprocket gear 64 that meshes with a worm gear 66 on the motor shaft 34, as shown in FIG. 7. When the motor 32 is in operation, the worm gear 66 rotates the sprocket gear 64, which in turn rotates the second shaft 54.

A first belt 68 connects the first pulleys 56,60 and a second belt 70 connects the second pulleys 58,62, such that the rotating second shaft 54 rotates its own pulleys 60,62 and the first shaft pulleys 56,58, the first shaft pulleys 56,58 then rotating the first shaft 52.

As shown in FIGS. 5–6 and FIGS. 9–10, a plurality of elongated rods 72 are attached to the belts 68,70 by the circular rod fasteners 74. This attachment allows the rods 72 to rotate within the fastener 74 and with respect to the belts 68,70. Each rod 72 extends between the belts 68, 70 and has suspension members 76 attached to the rod 72 using circular bearings 78 to allow the suspension members 76 to swing freely about the rod 72.

Each pair of suspension members 76 hingedly supports a generally planar shoe display platform 80, with each platform 80 having an elevated surface 82. As shown in FIG. 6, each platform 80 supports at least one pair of shoes 100, with the heels being positioned against the elevated surface 82. In another embodiment, the rods 72 are not rotatable with respect to the belts 68,70. In another embodiment, the rods 72 are so rotatable, but the suspension members 76 are not rotatable with respect to the rods 72.

In this embodiment 20, the platforms 80 are balanced on the suspension members 76 such that the loaded platforms 80 tip forward to form an angle with the horizon at or near forty-five degrees. In other embodiments, the platforms 80 are at varying positive and negative angles, including a substantially horizontal balanced position.

As the belts 68,70 are rotated by the second shaft first pulley 64 the rods 72 follow the belts 68,70 about the path shown clearly in FIG. 6.

In use, the user opens the hatch 24 and positions the pair of shoes 100 on the various display platforms 80. The motor controls 46 on the exterior control panel 30 are utilized to position an empty platform 80 proximate the open hatch 24. Depending on the environment of use, the user can use the light assembly controls 50 to provide an illuminated interior.

Once the shoes 100 are positioned on the platforms 80, the user sets the desired degree of humidification using the humidifier control 48. The user then closes the hatch 24 and the shoes 100 are enclosed in a protected storage environment, free from dust and other elements, and is also protected from room air that is often too dry for the long term exposure of leather shoes 100.

When the user later desires to retrieve a pair of shoes 100 from the device 20, the light control 50 is utilized to illuminate the shoes 100 then proximate the transparent hatch 24. The user then uses the motor controls 46 to rotate the shoe display platforms 80. As the motor 32 turns its shaft 34, the worm gear 66 rotates the sprocket gear 64, which in turn rotates the second shaft 54. As the second shaft 54 turns its first and second pulleys 60,62 turn and move the belts 68,70. As the belts 68,70 move, the rods 72 are also moved, with the attached suspension members 76 pulling the platforms 80 to a new position on the path of the belts 68,70. By viewing the illuminated shoes 100 through the transparent hatch 24 the user can determine when the desired pair of shoes 100 is proximate the hatch 24 and stop the motor 32. The user then opens the hatch 24, removes the shoes 100, and again closes the hatch 24. The ability to view the shoes 100 as they are proximate the hatch 24 allows minimal escape of the properly humidified air while the hatch 24 is open.

With respect to the above description then, it is to be realized that the optimum material and dimensional relationships for the parts of the shoe storage device 20, will include variations in size, materials, shape, and form, which will occur to those skilled in the art upon review of the present disclosure. For example, the housing 22 can be constructed from various woods, metals and plastics, and the shafts 52,54, pulleys 56,58,60,62, rods 72, suspension members 76, and platforms 80 can be constructed from sufficiently rigid woods, plastics, and metals. In other embodiments, the motor rotates the first shaft in an inline direct attachment to the motor shaft 34. In other embodiments, the platforms 80 have positive fasteners, such as loops, ties, straps and the like for securing the shoes on the platforms. All equivalent relationships to those illustrated in the drawings and described in the specification are intended to be encompassed by the present invention.

What is claimed as new and desired to be protected by Letters Patent is set forth in the appended claims:

1. A shoe storage device, comprising:

a housing having an interior and a closable access portion;

a humidifier positioned on the housing for humidifying the air in the housing interior, the humidifier having controls for regulating the degree of humidification;

a first and second pulley, each positioned within the housing for rotation;

a rotation member positioned on the housing for rotation, the rotation member having a shaft and a first and second pulley attached to the shaft;

a first belt for connecting the first pulleys, and a second belt for connecting the second pulleys;

a motor having controls, the motor being in rotative communication with the rotation member; and at least two shoe display assemblies, each display assembly having an elongated member, the elongated member having first and second ends attached to the first and second belts, each display assembly also having a platform and suspension members for suspending the platform from the elongated member, the suspension members being rotatable about the elongated member and the platform being rotatable on the suspension members, the platform being sized to support at least two shoes, the operation of the motor rotating the rotation member, the rotation member's first and second pulleys causing the first and second belts to rotate, the rotation of the belts carrying the at least two display assemblies along the first and second belt rotation path, each of the at least two platforms being proximate the closable access portion at some point in the first and second belt rotation path, such that the opened access portion provides access to the shoes for removal from the housing.

2. The shoe storage device of claim 1, wherein the shoe has a heel having forward edge and the display assembly platform has an elevated portion, the elevated portion being adapted to be adjacent the heel forward edge, such that, when the platform tips forward from the horizontal, the elevation prevents the shoe from sliding off the platform.

3. The shoe storage device of claim 1, wherein the closable access portion is at least partially transparent such that the platform supported shoes are at least partially visible when proximate the closable access portion.

4. The shoe storage device of claim 1, wherein the device further comprises a gear assembly, the gear assembly providing the rotative communication between the motor and the rotation member.

5. The shoe storage device of claim 4, wherein the gear assembly comprises a sprocket gear attached to the rotation member and a worm gear attached to the motor such that the motor rotates the worm gear and the worm gear rotates the sprocket gear.

6. The shoe storage device of claim 1, wherein the device further comprises a damper for damping the motor's operational vibrations.

7. The shoe storage device of claim 1, wherein the motor controls include an on-off function.

8. The shoe storage device of claim 1, wherein the motor controls include a speed variation function.

9. The shoe storage device of claim 1, wherein the motor controls include a forward-reverse function.

10. The shoe storage device of claim 1, wherein the motor controls include an automatic stop function such that each of the display assemblies is automatically stopped proximate the closable access portion.

11. The shoe storage device of claim 1, wherein the motor controls include an on-off function, a speed variation function, a forward-reverse function, and an automatic stop function such that each of the display assemblies is automatically stopped proximate the closable access portion.

12. The shoe storage device of claim 1, wherein the device further comprises a light assembly having a light member and controls, the light assembly being positioned on the housing such that the shoes are at least partially illuminated by the light member when the shoes are proximate the closable access portion.

13. The shoe storage device of claim 1, wherein the at least two display platforms are attached to the suspension members such that the platform is substantially horizontal when the platform is unloaded.

14. The shoe storage device of claim 1, wherein the at least two display platforms are attached to the suspension members such that the platform tips forward when the platform is unloaded.

15. The shoe storage device of claim 1, wherein each of the at least two display assembly platforms further comprise at least one fastener for securing at least one of the shoes to the platform.

16. A shoe storage device, comprising:

a housing having an interior and a closable access portion;

means for humidifying the housing interior;

at least two shoe display assemblies each sized for supporting at least one pair of shoes;

support means for supporting the display assemblies; and means for rotating the support means such that each display assembly is successively positioned proximate the closable access portion such that the opened access portion provides access to the shoes for removal from the housing.

17. The shoe storage device of claim 16, wherein each shoe has a heel, the heel having a forward edge, and each shoe display assembly further comprises means for obstructing the heel during relative movement between the shoe and the display assembly.

18. The shoe storage device of claim 17, wherein each of the at least two display assembly platforms further comprise means for securing at least one of the shoes to the platform.

19. The shoe storage device of claim 16, wherein each shoe display assembly further comprises means for securing the shoes on the display assembly.

20. The shoe storage device of claim 16, wherein the device further comprises means for damping the motor's operational vibrations.

21. The shoe storage device of claim 16, wherein the means for rotating the support means includes an on-off function.

22. The shoe storage device of claim 16, wherein the means for rotating the support means includes a rotation speed variation function.

23. The shoe storage device of claim 16, wherein the means for rotating the support means includes a forward-reverse function.

24. The shoe storage device of claim 16, wherein the means for rotating the support means includes an automatic stop function such that each of the display assemblies is automatically stopped proximate the closable access portion.

25. The shoe storage device of claim 16, wherein the means for rotating the support means includes an on-off function, a speed variation function, a forward-reverse function, and an automatic stop function such that each of the display assemblies is automatically stopped proximate the closable access portion.

26. The shoe storage device of claim 16, wherein the device further comprises means for at least partially illuminating the shoes when the shoes are proximate the closable access portion.

27. A shoe storage device, comprising:

a housing having an interior and a closable access portion;

a humidifier positioned on the housing for humidifying the air in the housing interior, the humidifier having controls for regulating the degree of humidification;

a first and second pulley, each positioned within the housing for rotation;

a rotation member positioned on the housing for rotation, the rotation member having a shaft and a first and second pulley attached to the shaft;

a first belt for connecting the first pulleys, and a second belt for connecting the second pulleys;

a motor having controls, the motor being in rotative communication with the rotation member; and at least two shoe display assemblies, each display assembly having an elongated member, the elongated member having first and second ends attached to the first and second belts, the attachment allowing rotation of the elongated member ends with respect to the belts, each display assembly also having a platform and suspension members for suspending the platform from the elongated member, the platform being rotatable on the suspension members, the platform being sized to support at least two shoes, the operation of the motor rotating the rotation member, the rotation member's first and second pulleys causing the first and second belts to rotate, the rotation of the belts carrying the at least two display assemblies along the first and second belt rotation path, each of the at least two platforms being proximate the closable access portion at some point in the first and second belt rotation path, such that the opened access portion provides access to the shoes for removal from the housing.

28. A shoe storage device, comprising:

a housing having an interior and a closable access portion, the closable access portion being at least partially transparent;

a humidifier positioned on the housing for humidifying the air in the housing interior, the humidifier having controls for regulating the degree of humidification;

a first and second pulley, each positioned within the housing for rotation;

a rotation member positioned on the housing for rotation, the rotation member having a shaft and a first and second pulley attached to the shaft;

a first belt for connecting the first pulleys, and a second belt for connecting the second pulleys;

a motor having controls; and a gear assembly having a sprocket gear attached to the rotation member and a worm gear attached to the motor such that the motor rotates the worm gear and the worm gear rotates the sprocket gear;

a damper for damping motor vibrations;

at least two shoe display assemblies, each display assembly having an elongated member, the elongated member having first and second ends attached to the first and second belts, each display assembly also having a platform, the platform having an elevated portion, and suspension members for suspending the platform from the elongated member, the suspension members being rotatable about the elongated member and the platform being rotatable on the suspension members, the platform being sized to support at least two shoes:

such that the rotation member is rotated by the sprocket gear, the rotation member's first and second pulleys causing the first and second belts to rotate, the rotation of the belts carrying the at least two display assemblies along the first and second belt rotation path, each of the at least two display assemblies being proximate the closable access portion at some point in the first and second belt rotation path, such that the opened access portion provides access to the shoes for removal from the housing;

and further such that, when the platform tips forward from the horizontal, the elevation prevents the shoe from sliding off the platform;

and further wherein the motor controls include an on-off function, a speed variation function, a forward-reverse function, and an automatic stop function such that each of the display assemblies is automatically stopped proximate the closable access portion; and a light assembly having a light member and controls, the light assembly being positioned on the housing such that the shoes are at least partially illuminated by the light member when the shoes are proximate the closable access portion.

* * * * *